US008730052B1

(12) United States Patent
DePoy

(10) Patent No.: US 8,730,052 B1
(45) Date of Patent: May 20, 2014

(54) EXTERNAL ANTENNA DETECTION DEVICE

(71) Applicant: Landis+Gyr Innovations, Inc., Alpharetta, GA (US)

(72) Inventor: Anthony DePoy, Cumming, GA (US)

(73) Assignee: Landis+Gyr Innovations, Inc., Alpharetta, GA (US)

( * ) Notice: Subject to any disclaimer, the term of this patent is extended or adjusted under 35 U.S.C. 154(b) by 51 days.

(21) Appl. No.: 13/666,459

(22) Filed: Nov. 1, 2012

(51) Int. Cl.
*G08B 21/00* (2006.01)

(52) U.S. Cl.
USPC ..... 340/635; 340/641; 340/686.1; 340/637

(58) Field of Classification Search
USPC ..... 340/635, 635.12, 636.15, 641, 649, 340/650, 686.1, 637; 455/277.1, 550.1
See application file for complete search history.

(56) References Cited

U.S. PATENT DOCUMENTS 7,003,330 B2 * 2/2006 Moles ..... 455/572

OTHER PUBLICATIONS

"Antenna Detection Application Note; Telit Wireless Solutions;" Mar. 19, 2012; 15 pages.
"Web page; http://en.wikipedia.org/wiki/Bias_tee;" Dec. 11, 2012, 3 pages.

* cited by examiner

*Primary Examiner* — Toan N Pham
(74) *Attorney, Agent, or Firm* — Kilpatrick Townsend & Stockton LLP

(57) ABSTRACT

Systems and methods for detecting that a removable antenna is electrically connected to a communication device are disclosed. An exemplary detection device includes a visual indicator component and a data indicator component. The visual indicator component electrically connects to an RF antenna connector of the communication device. The visual indicator component generates a visual indicator in response to the RF antenna connector being connected to the removable antenna. The RF antenna connector being connected to the removable antenna provides electrical paths through the visual indicator component and through the data indicator component from at least one voltage source to ground. The data indicator component electrically connects to the RF antenna connector. The data indicator component generates a data indicator in response to the RF antenna connector being connected to the removable antenna.

20 Claims, 5 Drawing Sheets

EXTERNAL ANTENNA DETECTION DEVICE

TECHNICAL FIELD

This disclosure relates generally to communication devices and more particularly relates to a device for detecting whether a removable antenna is connected to a communication device.

BACKGROUND

Communication devices, such as electrical power meters in a power line network or other utility endpoints or measuring devices, can include both network communication devices, such as a network interface card, and radio communication devices, such as an external antenna. During manufacturing, a power meter or other utility endpoint device can be assembled and calibrated. Calibrating the power meter or other device can include testing the primary functions of the device. Assembling the power meter or other device can include connecting the external antenna. Errors in the assembly process can cause the external antenna to become disconnected. If communication functions of the power meter are not tested during the manufacturing process, the disconnection of the external antenna may not be discovered until the power meter or other device is installed in a target system.

Therefore, it is desirable to provide systems and methods for verifying the connectivity of an external antenna to a communication device.

SUMMARY

Systems and methods are disclosed for detecting whether an external or other removable antenna is electrically connected to a communication device. An exemplary detection device includes a visual indicator component and a data indicator component. The visual indicator component electrically connects to an RF antenna connector of the communication device. The visual indicator component generates a visual indicator in response to the RF antenna connector being connected to the removable antenna. The RF antenna connector being connected to the removable antenna provides electrical paths through the visual indicator component and through the data indicator component from at least one voltage source to ground. The data indicator component electrically connects to the RF antenna connector. The data indicator component generates a data indicator in response to the RF antenna connector being connected to the removable antenna.

These illustrative aspects and features are mentioned not to limit or define the invention, but to provide examples to aid understanding of the inventive concepts disclosed in this application. Other aspects, advantages, and features of the present invention will become apparent after review of the entire application.

BRIEF DESCRIPTION OF THE FIGURES

These and other features, aspects, and advantages of the present disclosure are better understood when the following Detailed Description is read with reference to the accompanying drawings, where.

DETAILED DESCRIPTION

Figure 1:
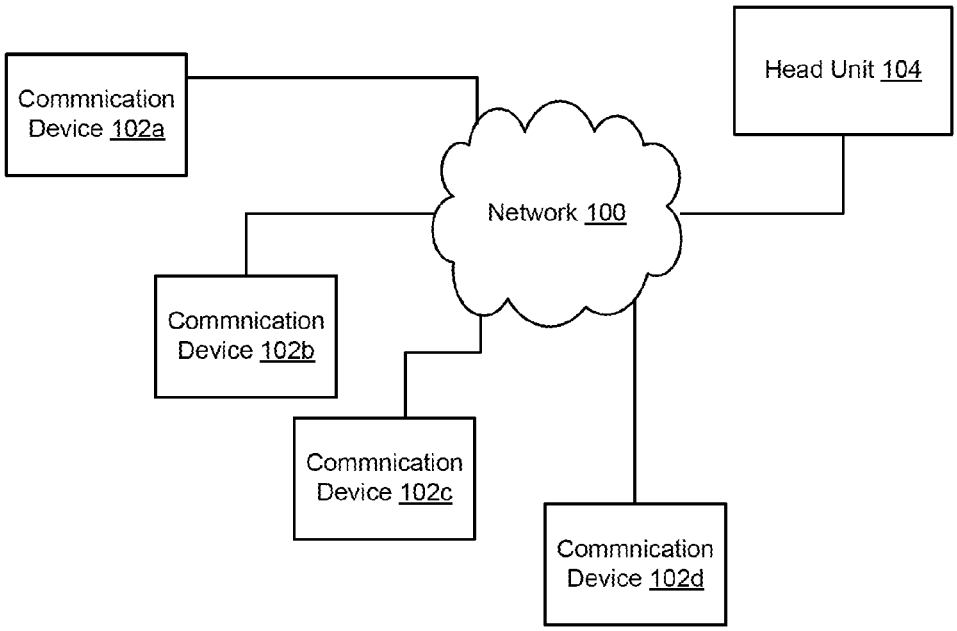
FIG. 1 is a network diagram illustrating an exemplary data network including communication devices in communication with a head unit.

Systems and methods are provided for detecting whether a removable antenna is electrically connected to a communication device. A detection device can include circuitry for generating a visual indicator and a data indicator identifying whether the removable antenna and the communication device are electrically connected. An example of a visual indicator is an emitted light. An example of a data indicator is a connectivity status flag in the firmware of the communication device. The visual indicator and data indicator can thus allow a disconnected antenna to be detected during manufacturing of the communication device, thereby allowing manufacturing errors to be corrected prior to deployment of the communication device.

In an exemplary aspect, a detection device is provided for detecting that a removable antenna is electrically connected to a communication device. The detection device can include a visual indicator component and a data indicator component. The visual indicator component can electrically connect to an RF antenna connector of the communication device. The RF antenna connector being connected to the removable antenna provides one or more electrical paths from at least one voltage source to ground. The visual indicator component generates a visual indicator in response to the RF antenna connector being connected to the removable antenna. The data indicator component can also be electrically connected to the RF antenna connector. In some aspects, the data indicator component can be connected in parallel with the data indicator component. The data indicator component can generate a data indicator in response to the RF antenna connector being connected to the removable antenna.

In additional or alternative aspects, the visual indicator component includes a resistor and a light-emitting diode in series with the RF antenna connector and the voltage source. In some aspects, connecting the removable antenna to the RF antenna connector can provide an electrical path through the resistor and the light-emitting diode. Current can flow from the anode to the cathode of the light-emitting diode, thereby causing light to be emitted from the diode. The visual indicator can be the emitted light.

In additional or alternative aspects, the visual indicator component can include one or more components providing an inverse logic function. Disconnecting the removable antenna to the RF antenna connector can cause the light-emitting diode to emit light. The inverse logic function can cause connecting the removable antenna to the RF antenna connector to prevent light from being emitted by the light-emitting diode. The visual indicator can be the cessation of the emitted light.

In additional or alternative aspects, the data indicator component includes a resistor in series with the RF antenna connector and the voltage source and a processor. The processor can generate the data indicator in response to the RF antenna connector being connected to the removable antenna and thereby providing the electrical path through the resistor. The processor can generate the data indicator based on detecting a voltage at the resistor. For example, the processor can detect a voltage difference across the resistor. In additional or alternative aspects, the processor can store a connectivity status of the removable antenna in a non-transitory computer readable medium. The processor can also generate a data message for the communication device to communicate via a data network. The data message can notify an operator that the removable antenna is electrically connected to the communication device.

In additional or alternative aspects, the detection device can detect subsequent tampering with the removable antenna. In response to the RF antenna connector being disconnected from the removable antenna, the processor can detect a loss of the voltage at resistor of the data indicator component. The processor can generate an additional data indicator based on the loss of the detected voltage. The additional data indicator indicates that the removable antenna is not electrically connected to the communication device. The processor can also generate an alert message for the communication device to communicate via a data network. The alert message can notify an operator that the removable antenna is not electrically connected to the communication device.

As used herein, the term "data indicator" is used to refer to one or more electronic signals indicative of a connection status between a removable antenna and a communication device.

As used herein, the term "communication device" is used to refer to any device capable of communicating with other devices. In some aspects, a communication device can communicate with other devices via a data network. In other aspects, a communication device can communicate with other devices via RF signals communicated directly to other devices.

As used herein, the term "data network" is used to refer to a group of devices interconnected by communication channels that allow sharing of resources and information. A communication channel can include any suitable means for communicating data over network, such as (but not limited to) a copper cable, a fiber optic cable, a wireless transmission, etc.

These illustrative examples are given to introduce the reader to the general subject matter discussed here and are not intended to limit the scope of the disclosed concepts. The following sections describe various additional aspects and examples with reference to the drawings in which like numerals indicate like elements.

The features discussed herein are not limited to any particular hardware architecture or configuration. A computing device can include any suitable arrangement of components that provide a result conditioned on one or more inputs. Suitable computing devices include multipurpose microprocessor-based computer systems accessing stored software that programs or configures the computing system from a general-purpose computing apparatus to a specialized computing apparatus implementing one or more aspects of the present subject matter. Any suitable programming, scripting, or other type of language or combinations of languages may be used to implement the teachings contained herein in software to be used in programming or configuring a computing device.

Referring now to the drawings, FIG. 1 is a network diagram illustrating an exemplary data network 100 having communication devices 102*a-d* in communication with a head unit 104.

The data network 100 can provide communication channels among the head unit 104 and the communication devices 102*a-d*. A communication channel can include any suitable means capable of communicating signals among the communication devices 102*a-d* and the head unit 104. Examples of suitable communication media include (but are not limited to), Ethernet cable, wireless data communication, power cables for use in power line communication ("PLC"), etc. Power line communication can include communicating signals via cables used for providing electric power from a utility company to buildings in a geographic area.

The data network 100 can be configured using any suitable network topology. For example, the data network 100 can be a mesh network. A data network 100 that is a mesh network can include each of the communication devices 102*a-d* being configured to relay data received from other network devices, such that the communication devices 102*a-d* collaborate to propagate the data through the data network 100. Other suitable network topologies can include (but are not limited to), a ring network, a star network, a bus network, etc.

The communication devices 102*a-d* can include any device communicating data via the data network 100. Each of the communication devices 102*a-d* can include one or more hardware components for physically interfacing with the data network 100, such as (but not limited to) a network interface controller. Each of the communication devices 102*a-d* can include a computer readable medium or other suitable memory device. Each of the communication devices 102*a-d* can include a processor configured to execute software instructions stored in the computer readable medium.

The head unit 104 can be a network device configured to collect and process data from other network devices on the data network. The head unit 104 can provide a link between the data network 100 and other networks. Examples of a head unit 104 include, but are not limited to, a dedicated controller such as a server system, a router, or a network device similar to the communication devices 102*a-d* and having an additional network controller capability. The head unit 104 can communicate data to each of the communication devices 102*a-d*. The head unit 104 can remotely configure the communication devices 102*a-d* via control signals communicated via the data network 100.

Although FIG. 1 depicts a data network 100 having a single head unit 104 and four communication devices 102*a-d*, any number of network controllers and/or network devices can be used. In additional or alternative aspects, a head unit can be omitted. For example, in a peer-to-peer data network, one or more of the functions that would otherwise be executed at the head unit 104 can be performed by one or more of the communication devices.

Figure 2:
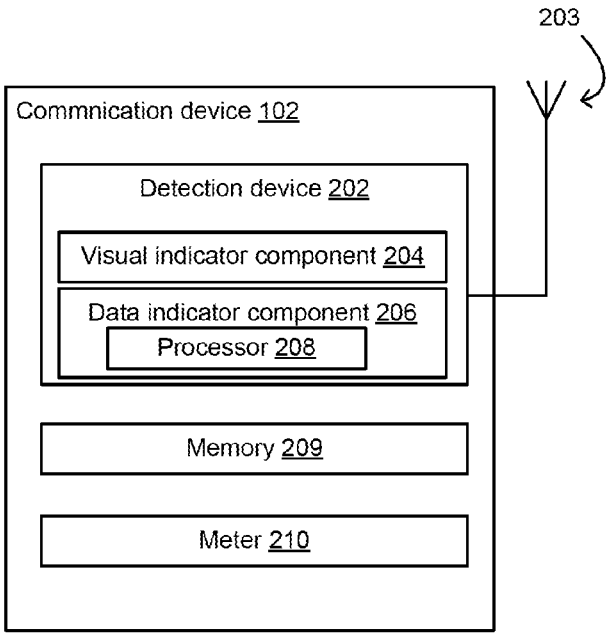
FIG. 2 is a block diagram illustrating an exemplary communication device having a detection device for detecting a connection to a removable antenna.

In an exemplary aspect, a data network 100 can be a PLC network, a head unit 104 can be a command center, and each of the communication devices 102*a-d* can include a power meter or other utility endpoint or measuring device. For example, FIG. 2 is a block diagram illustrating an exemplary communication device 102 including a detection device 202, a processor 208, a memory 209, and a power meter 210.

The processor 208 can be any suitable processing device or group of devices configured to execute instructions stored in the memory 209. Non-limiting examples of the processor 208 can include a microprocessor, a mixed signal microcontroller, an application-specific integrated circuit ("ASIC"), a field-programmable gate array ("FPGA"), or other suitable.

The memory 209 can be any suitable non-transitory computer-readable medium for storing computer-executable program instructions, such as firmware or other operating instructions for controlling one or more hardware components of the communication device 102. A non-transitory computer-readable medium may include, but is not limited to, an electronic, optical, magnetic, or other storage device capable of providing a processor with computer-readable instructions. Other examples include, but are not limited to, a memory chip, ROM, RAM, an ASIC, a configured processor, optical storage, or any other medium from which a computer processor can read instructions. The instructions may include processor-specific instructions generated by a compiler and/or an interpreter from code written in any suitable computer-programming language, including, for example, C, C++, C#, Python, Perl, JavaScript, etc.

The power meter 210 can be any suitable device for recording data describing the consumption of electrical power at the geographic location of the communication device 102. The communication device 102 can transmit data describing the consumption of electrical power via the PLC network.

The communication device 102 can communicate with other communication devices via a removable antenna 203. An RF signal source can provide an RF signal via a coaxial cable to a removable antenna 203. An example of a removable antenna 203 is a planar antenna, such as a Planar Inverted-F Antenna ("PIFA"). The removable antenna 203 can radiate the RF signal.

Although FIG. 2 depicts a communication device 102 including a meter 208, other implementations are possible. In additional or alternative aspects, the communication device 102 can be include any suitable utility endpoint or measuring device, such as another device or group of devices configured to monitor, record, process, or otherwise use data to be communicated by the communication device 102.

The detection device 202 can include visual indicator component 204 and a data indicator component 206 for detecting an electrical connection with the removable antenna 203. A visual indicator component 204 of the detection device 202 can generate a visual indicator that identifies the status of the electrical connection. A data indicator component 206 of the detection device 202 can generate a data indicator that identifies the status of the electrical connection.

Figure 3:
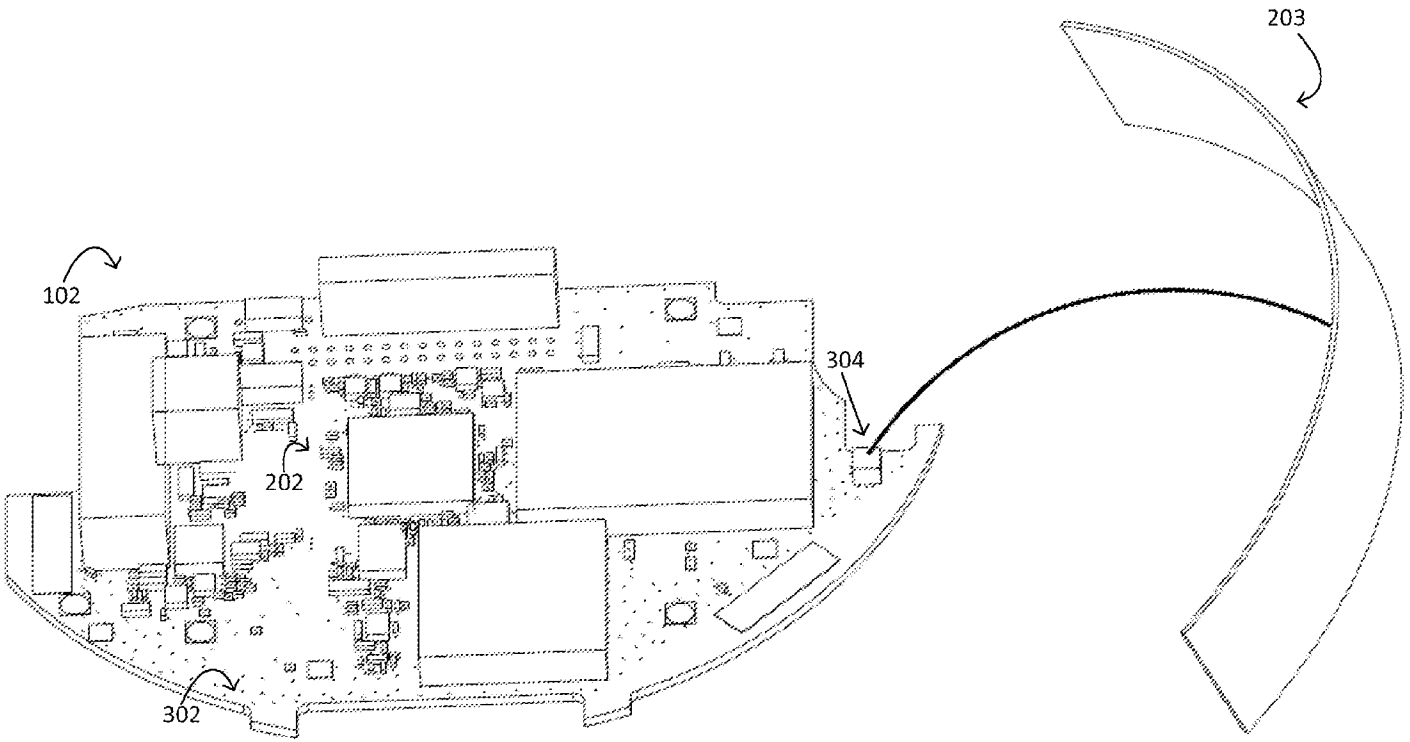
FIG. 3 is a diagram illustrating an example communication device in which a detection device can be disposed.

FIG. 3 is a view of a partially disassembled example communication device 102 in which a detection device 202 can be disposed. The communication device 102 can include a printed circuit board 302. The detection device 202 and processor 208 can be integrated into or otherwise connected via the printed circuit board 302. An RF antenna connector 304 of the printed circuit board 302 can provide an electrical connection to the removable antenna 203.

Figure 4:
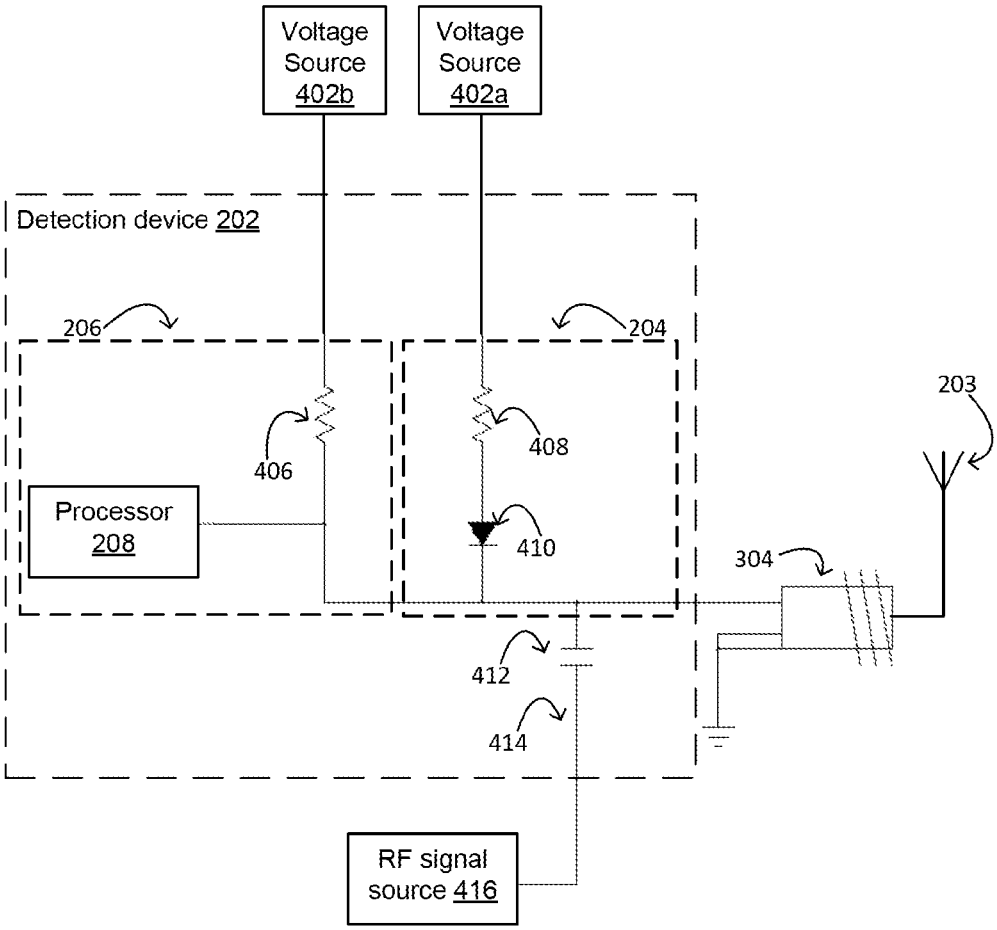
FIG. 4 is a schematic diagram depicting an exemplary detection device for detecting a connection to a removable antenna.

FIG. 4 is a schematic diagram depicting an example detection device 202. The detection device 202 includes the visual indicator component 204 that is connected to a voltage source 402*a*. The detection device 202 also includes the data indicator component 206 that is electrically connected to a voltage source 402*b*. Although FIG. 4 depicts the visual indicator component 204 and the data indicator component 206 respectively connected to separate voltage sources 402*a*, 402*b*, other implementations are possible. For example, the visual indicator component 204 and the data indicator component 206 can be connected in parallel to a common voltage source, such as a power supply pin of the printed circuit board 302 for receiving a 3.3 DC voltage powering the communication device 102.

The detection device 202 can be electrically connected to the removable antenna 203 via the RF antenna connector 304. Electrically connecting the RF antenna connector 304 to the removable antenna 203 can provide electrical paths from the voltage sources 402*a*, 402*b* to ground. The visual indicator can be generated in response to the RF antenna connector 304 providing an electrical path from the voltage source 402*a* to ground through the visual indicator component 204. The data indicator can be generated in response to the RF antenna connector 304 providing an electrical path from the voltage source 402*b* to ground through the data indicator component 206.

The visual indicator component 204 can include a resistor 408, such as a 1 kilo-ohm resistor, and a light-emitting diode 410. The voltage source 402*a* is connected via the resistor 408 to the anode of the light-emitting diode 410. The cathode of light-emitting diode 410 is connected to an electrical path to the RF antenna connector 304. If the RF antenna connector 304 is not electrically connected to the removable antenna 203, the resulting open circuit prevents current from flowing through the cathode of the light-emitting diode 410. If the RF antenna connector 304 is electrically connected to the removable antenna 203, current can flow through the cathode of the light-emitting diode 410, thereby causing light to be emitted. The emitted light can be a visual indicator that the RF antenna connector 304 is electrically connected to the removable antenna 203.

The visual indicator component 204 can include a resistor 406, such as a 1 mega-ohm resistor, and the processor 208. If the RF antenna connector 304 is electrically connected to the removable antenna 203, current can flow through resistor 406. The processor 208 can detect a voltage at the resistor 406. For example, the processor 208 can detect a voltage difference across the resistor 406. The processor 208 can generate a data indicator in response to detecting the voltage. Generating the data indicator can include storing the data indictor in the memory 209. For example, the processor 208 can modify the value of a connectivity status flag in the firmware of the communication device 102, such as setting a bit value in a register to 1. The value of the connectivity status flag can indicate an electrical connection to the removable antenna 203.

In some aspects, the processor 208 can generate a data message specifying that the removable antenna 203 is electrically connected to the communication device 102. The data message can be communicated to the head unit 104 via the data network 100. In other aspects, a diagnostic tool external to the communication device 102 can access the data indicator stored in the memory 209 via a diagnostic pin of the printed circuit board 302.

In additional or alternative aspects, the processor 208 can also detect a cessation of the current and/or voltage at the resistor 406. The processor 208 can generate an additional data indicator based on the loss of the detected voltage or current. For example, the processor 208 can modify the value of the connectivity status flag in the firmware of the communication device 102, such as setting a bit value in a register to 0. The additional data indicator can indicate that the removable antenna 203 is not electrically connected to the communication device 102.

In some aspects, the resonance of the removable antenna 203 can generate the electrical path from a voltage source to ground that allows current to flow through the data indicator component 206 and/or the visual indicator component 204. For example, a removable antenna 203 can be a PIFA patch antenna. During standard operation of the communication device 102, an RF signal source 416 can provide one or more RF signals via a transmission line 414, such as a coaxial cable or other suitable RF transmission medium. A DC blocking capacitor 412 can connect the transmission line 414 via capacitive coupling to a signal path including the removable antenna 203. An RF signal can be transmitted via a transmission line 414 to the RF connecter 304. The PIFA antenna can be constructed by shorting a feed of the transmission line 414 from the RF signal source 416 to the ground plane of the PIFA antenna. Grounding the feed point of the transmission line 414 can provide a short-circuit at DC and allow the frequency of interest for the RF signal to be transmitted. The feed can be positioned between the open and shorted end. The position of the feed can control the input impedance to, for example, 50 Ohms at 900 MHz, thereby allowing current flow through the communication device 102 and/or the detection device 202.

In additional or alternative aspects, the visual indicator component 204 can include one or more components providing an inverse logic function. For a detection device including an inverse logic function, disconnecting the removable antenna from the RF antenna connector can cause the light-emitting diode 410 to emit light. The inverse logic function can cause connecting the removable antenna 203 to the RF antenna connector 304 to prevent light from being emitted by the light-emitting diode 410. The visual indicator can be the cessation of the emitted light.

Figure 5:
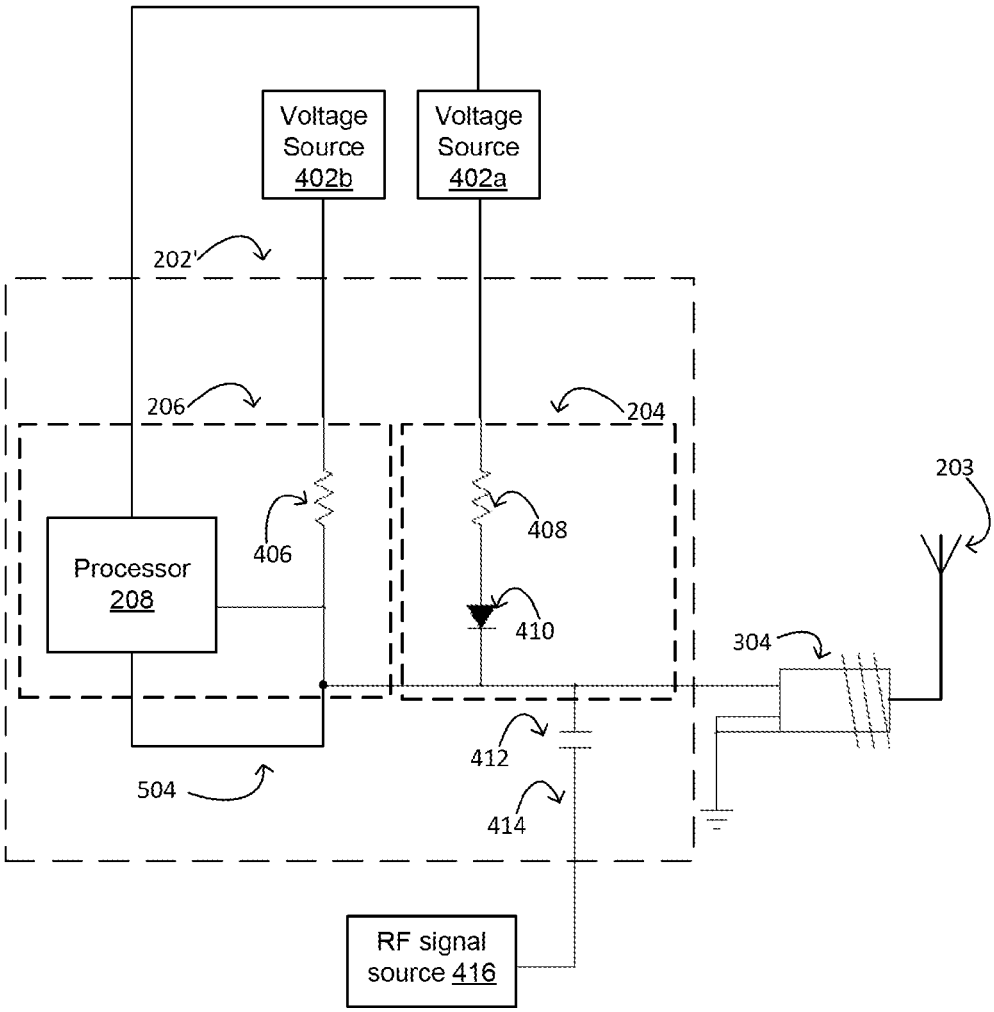
FIG. 5 is a schematic diagram depicting an exemplary detection device providing an inverse logic function for detecting a connection to a removable antenna.
Figure 6:
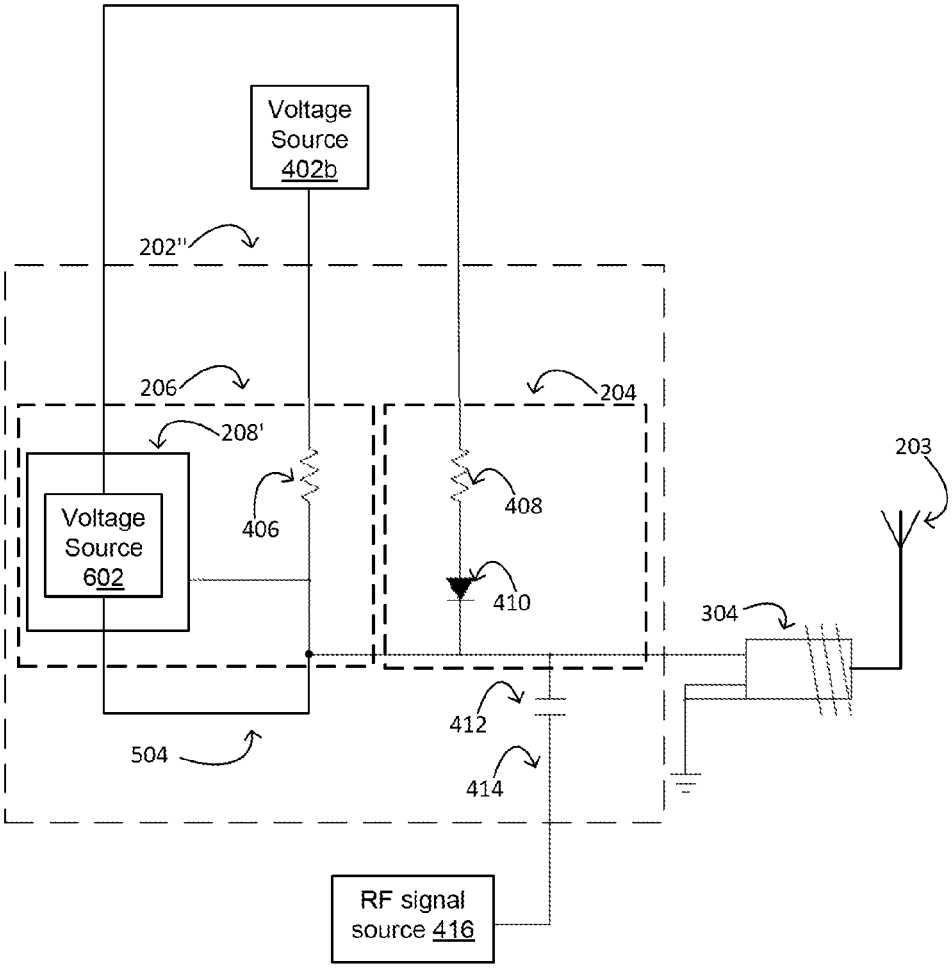
FIG. 6 is a schematic diagram depicting an alternative detection device providing an inverse logic function for detecting a connection to a removable antenna.

FIGS. 5-6 are schematic diagrams depicting example detection devices using inverse logic. As depicted in FIG. 6, the processor 208 of the detection device 202' can be connected to the voltage source 402*a*. The processor 208 can control the state of the voltage source 402*a*. The processer 208 can detect a change in a logic level from the resistor 406 based on the antenna 203 being disconnected. The processor 208 can generate a command to toggle the state on voltage source 402*a* from a low input to a high input. The processor 208 can also generate a command to toggle a low state on line 504 from the processor 208. Toggling the state on voltage source 502 from a low input to a high input and toggling a low state on line 504 can allow current to flow through light-emitting diode 410, thereby emitting light.

As depicted in FIG. 6, the processor 208' of the detection device 202" can include a voltage source 602. The voltage source 602 is connected via the resistor 408 to the anode of the light-emitting diode 410. The processer 208' can detect a change in a logic level from the resistor 406 based on the antenna 203 being disconnected. The processor 208 can generate a command to toggle the state on voltage source 602 from a low input to a high input. The processor 208 can also generate a command to toggle a low state on line 504 from the processor 208. Toggling the state on voltage source 502 from a low input to a high input and toggling a low state on line 504 can allow current to flow through light-emitting diode 410, thereby emitting light.

General

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Some portions are presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm is a self-consistent sequence of operations or similar processing leading to a desired result. In this context, operations or processing involves physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these and similar terms are to be associated with appropriate physical quantities and are merely convenient labels. Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other storage devices, transmission devices, or display devices of the computing platform.

The system or systems discussed herein are not limited to any particular hardware architecture or configuration. A computing device can include any suitable arrangement of components that provide a result conditioned on one or more function calls. Suitable computing devices include multipurpose microprocessor-based computer systems accessing stored software that programs or configures the computing system from a general-purpose computing apparatus to a specialized computing apparatus implementing one or more aspects of the present subject matter. Any suitable programming, scripting, or other type of language or combinations of languages may be used to implement the teachings contained herein in software to be used in programming or configuring a computing device.

Aspects of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific aspects thereof, it will be appreciated that those skilled in the art, upon attaining an understanding of the foregoing, may readily produce alterations to, variations of, and equivalents to such aspects. Accordingly, it should be understood that the present disclosure has been presented for purposes of example rather than limitation, and does not preclude inclusion of such modifications, variations, and/or additions to the present subject matter as would be readily apparent to one of ordinary skill in the art.

The invention claimed is:

1. A detection device configured to detect that a removable antenna is electrically connected to a communication device, the detection device comprising:

a visual indicator component electrically connected to an RF antenna connector of the communication device and to generate a visual indicator in response to the RF antenna connector being connected to the removable antenna;

a data indicator component electrically connected to the RF antenna connector and to generate a data indicator in response to the RF antenna connector being connected to the removable antenna;

wherein the RF antenna connector being connected to the removable antenna provides a first electrical path through the visual indicator component and a second electrical path through the data indicator component from at least one voltage source to ground.

2. The detection device of claim 1, wherein the visual indicator component comprises a light-emitting diode in series with the RF antenna connector and the at least one voltage source, wherein the RF antenna connector being connected to the removable antenna generates current through the light-emitting diode such that light is emitted from the light-emitting diode, wherein the visual indicator comprises the light emitted from the light-emitting diode.

3. The detection device of claim 1, wherein the data indicator component comprises a processor and a resistor in series with the RF antenna connector and the at least one voltage source, wherein the processor is configured to:

detect a voltage at the resistor generated by the RF antenna connector being connected to the removable antenna; and generate the data indicator based on detecting the voltage.

4. The detection device of claim 3, wherein the processor is configured to generate the data indicator by modifying a value of a connectivity status flag stored in a non-transitory computer readable medium.

5. The detection device of claim 3, wherein the processor is further configured to generate a data message for the communication device to communicate via a data network, wherein the data message specifies that the removable antenna is electrically connected to the communication device.

6. The detection device of claim 3, wherein the processor is further configured to:

detect a loss of the voltage at the resistor in response to the RF antenna connector being disconnected from the removable antenna; and generate an additional data indicator based on the loss of the detected voltage, the additional data indicator indicating that the removable antenna is not electrically connected to the communication device.

7. The detection device of claim 6, wherein the processor is further configured to generate an alert message for the communication device to communicate via a data network, wherein the alert message specifies that the removable antenna is not electrically connected to the communication device.

8. A system comprising:

a communication device configured to be selectively connected to a removable antenna;

an RF antenna connector configured to provide an electrical connection between the communication device and the removable antenna; and a detection device configured to detect that the removable antenna is electrically connected to the communication device, the detection device comprising:

a visual indicator component electrically connected to the RF antenna connector and to generate a visual indicator in response to the RF antenna connector being connected to the removable antenna, and a data indicator component electrically connected to the RF antenna connector and to generate a data indicator in response to the RF antenna connector being connected to the removable antenna;

wherein the RF antenna connector being connected to the removable antenna provides a first electrical path through the visual indicator component and a second electrical path through the data indicator component from at least one voltage source to ground.

9. The system of claim 8, wherein the visual indicator component comprises a resistor and a light-emitting diode in series with the RF antenna connector and the at least one voltage source, wherein the RF antenna connector being connected to the removable antenna generates current through the resistor and the light-emitting diode such that light is emitted from the light-emitting diode, wherein the visual indicator comprises the light emitted from the light-emitting diode.

10. The system of claim 8, wherein the data indicator component comprises a processor and a resistor in series with the RF antenna connector and the at least one voltage source, wherein the processor is configured to:

detect a voltage at the resistor generated by the RF antenna connector being connected to the removable antenna; and generate the data indicator based on detecting the voltage.

11. The system of claim 10, wherein the processor is configured to generate the data indicator by storing a connectivity status of the removable antenna in a non-transitory computer readable medium.

12. The system of claim 10, wherein the processor is further configured to generate a data message specifying that the removable antenna is electrically connected to the communication device;

wherein the communication device is configured to transmit the data message via a data network.

13. The system of claim 12, wherein the processor is further configured to, in response to the RF antenna connector being disconnected from the removable antenna:

detect a loss of the voltage at the resistor; and generate an additional data indicator based on the loss of the detected voltage, the additional data indicator indicating that the removable antenna is not electrically connected to the communication device.

14. The system of claim 13, wherein the processor is further configured to generate an alert message specifying that the removable antenna is not electrically connected to the communication device; and wherein the communication device is further configured to communicate the alert message via the data network.

15. The system of claim 8, wherein the removable antenna comprises a patch antenna configured to generate a resonant circuit providing the electrical path from the at least one voltage source to ground.

16. A method comprising:

providing a first electrical path through a visual indicator component and a second electrical path through a data indicator component from at least one voltage source to ground by electrically connecting a removable antenna to an RF antenna connector of a communication device, wherein the visual indicator component and the data indicator component are connected to the RF antenna connector;

generating, by the visual indicator component, a visual indicator in response to the RF antenna connector being connected to the removable antenna; and generating, by the data indicator component, a data indicator in response to the RF antenna connector being connected to the removable antenna.

17. The method of claim 16, wherein the visual indicator component comprises a resistor and a light-emitting diode in series with the RF antenna connector and the at least one voltage source, wherein the visual indicator comprises light emitted by the light-emitting diode in response to providing the first electrical path through the resistor and the light-emitting diode.

18. The method of claim 16, wherein the data indicator component comprises a processor and a resistor in series with the RF antenna connector and the at least one voltage source and wherein generating the data indicator comprises:

detecting, by the processor, a voltage at the resistor generated by the RF antenna connector being connected to the removable antenna; and generating, by the processor, the data indicator based on the detected voltage.

19. The method of claim 18, further comprising:

generating, by the processor, a data message specifying that the removable antenna is electrically connected to the communication device; and transmitting, by the communication device, the data message via a data network.

20. The method of claim 19, further comprising:

detecting, by the processor, a loss of the voltage at the resistor; and responsive to detecting the loss of the voltage, generating, by the processor, an additional data indicator indicating that the removable antenna is not electrically connected to the communication device; and generating, by the processor, an alert message specifying that the removable antenna is not electrically connected to the communication device.

* * * * *